United States Patent [19]

della Porta

[11] Patent Number: 4,504,765

[45] Date of Patent: Mar. 12, 1985

[54] SUPPORT TAB FOR GETTER DEVICES

[75] Inventor: Paolo della Porta, Milan, Italy

[73] Assignee: SAES Getters SpA, Milan, Italy

[21] Appl. No.: 377,458

[22] Filed: May 12, 1982

[30] Foreign Application Priority Data

May 20, 1981 [IT] Italy ..... 21851 A/81

[51] Int. Cl.[3] ..... H01J 17/24; H01J 19/70

[52] U.S. Cl. ..... 313/481; 313/561

[58] Field of Search ..... 313/481, 553, 558, 559, 313/560, 561

[56] References Cited

U.S. PATENT DOCUMENTS 3,659,133 4/1972 Tsuneta et al. ..... 313/417

3,669,567 6/1972 Porta et al. ..... 313/561

3,996,488 12/1976 Zucchinelli ..... 417/48 X

*Primary Examiner*—Palmer Demeo

*Assistant Examiner*—Sandra L. O'Shea

*Attorney, Agent, or Firm*—Quaintance & Murphy

[57] ABSTRACT

An improved getter assembly for mounting a getter device in an electron tube comprising a holder for supporting an evaporable getter metal vapor releasing material and a support tab member wherein the support tab member comprises a quadrilateral element one edge of which is attached to the getter assembly and the two edges adjacent to said one edge integrally supporting each respectively a first and second reinforcing element, so forming sidewall members in perpendicular relationship to the quadrilateral element and in abutting relationship with said holder.

2 Claims, 8 Drawing Figures

SUPPORT TAB FOR GETTER DEVICES

BACKGROUND OF THE INVENTION

This invention relates to an improved arrangement for mounting a getter device in an electron tube, particularly a television picture tube.

Getter devices are well known in the art, see for example U.S. Pat. Nos. 2,822,080; 3,207,294; 3,207,295 and 3,211,280. When getter devices are used in television picture tubes it is common practice to mount them in the so called antenna position, see U.S. Pat. No. 4,182,974. The getter device has also been attached to the frame of the shadow mask in colour television picture tubes, see U.S. Pat. No. 3,792,300.

Whatever their mounting position, use is frequently made of a tab which forms part of the getter device structure. The tab then allows the getter device to be held in its required position within the electron tube such as, for instance, by welding the tab to one end of an antenna spring within a television picture tube. Unfortunately, when the getter device is heated by induction from a R.F. coil positioned outside the tube, the tab is also heated and tends to soften and bend causing the getter container to move out of its proper position with all the resulting disadvantages and defects as described thoroughly in U.S. Pat. No. 3,558,961. This U.S. patent itself discloses an attempt to overcome the positioning problems that occur during getter device heating but, unfortunately, this attempt requires additional manufacturing steps to be performed on the antenna spring. The spring has also to be cut to shape from a strip much wider than that required for the actual spring width with the subsequent creation of large amounts of scrap material. It would, therefore, be advantageous if the tab of the getter device could itself be rendered more rigid.

Therefore, it is the primary object of this invention to provide an improved support tab member integrally formed with a getter metal vapour releasing material assembly.

It is another object of the present invention to provide an improved support tab member that ensures proper positioning of the getter device during and after heating the device.

Other objects and advantages of the present invention will become apparent from the following description whereof and drawings wherein.

Figure 6:
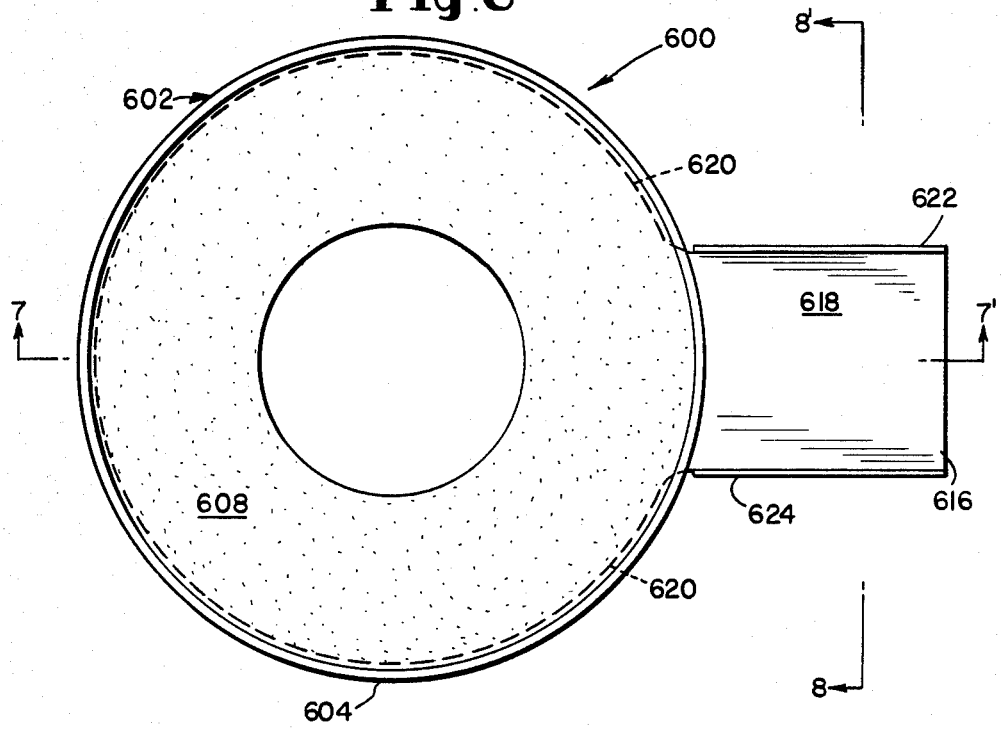
FIG. 6 is a top view of another getter device incorporating an improved support tab member of the present invention.
Figure 7:
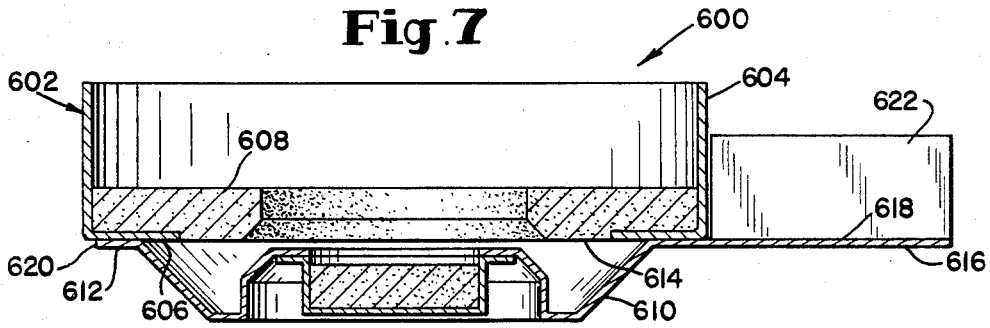
Figure 8:
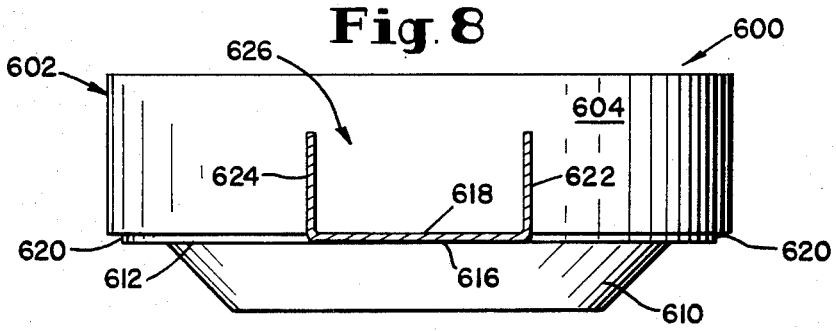

FIGS. 7 and 8 are cross-sectional views taken along line 7—7′ and 8—8′ respectively of FIG. 6.

The present invention provides an improved getter assembly for mounting a getter device in an electron tube, preferably a kinescope, which comprises a holder for supporting an evaporable getter metal vapour releasing material and an improved support tab member. The support tab member comprises a quadrilateral element one edge of which is attached to the getter assembly. The two edges adjacent to said one edge integrally support respectively a first and second reinforcing element so forming sidewall members. The sidewall members are in perpendicular relationship to the quadrilateral element and are in an abutting relationship with said holder. Abutting relationship means that edges 36 and 38 of sidewall members 30 and 34 are not in contact with outer wall 22, until the getter is heated, and edges 36 and 38 then move into abutment with outer wall 22.

The reinforcing elements may have any suitable shape as long as they maintain the abutting relationship with the holder. They are preferably polygonal and, for instance, they may conveniently be either triangular or rectangular.

The evaporable getter metal vapour releasing material generally comprises an alkaline earth metal such as magnesium, strontium or barium or their alloys. The most commonly used getter material is a powdered alloy of barium with aluminium containing about 50–56% barium by weight. It is frequently desirable to mix this barium-aluminium alloy with another material such that, upon heating, an exothermic chemical reaction takes place with release of barium vapour. The material may, for instance, be molybdenum or Ti-Ni alloys, but very often the material chosen is powdered nickel which is added in an approximate weight ratio of 2:1 to 1:2 and preferably in a weight ratio of 1:1 with the barium-aluminium alloy. Thus, the exothermic evaporable getter metal vapour releasing material contains about 25% by weight of barium. Very frequently there is also added a small percentage of gas releasing material such as $Fe_4N$ or the hydrides of Ti or Zr. The term "getter metal vapour releasing material" as used in the specification and claims herein is meant to include both the material prior to and after getter metal vapour release. This term embraces both the material in the form sold with the getter device and in the form in which it is found in an operating tube wherein the bulk of the getter metal has been evaporated from the material and is in the form of a film on the inside surfaces of the tube.

Figure 1:
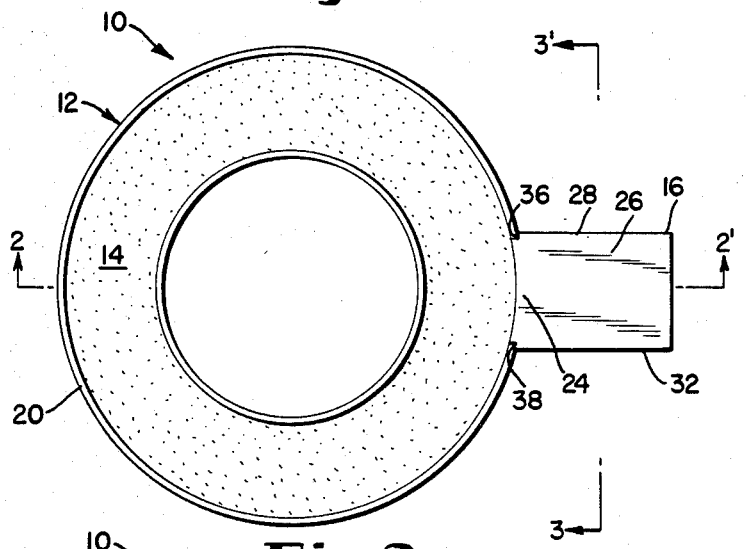
FIG. 1 is a top view of a getter device incorporating an improved support tab member of the present invention.
Figure 2:
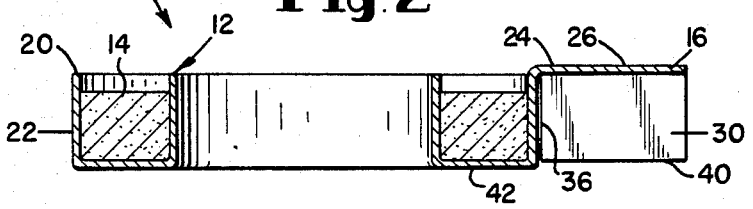
FIG. 2 is a cross-sectional view taken along line 2—2′ of FIG. 1.
Figure 3:
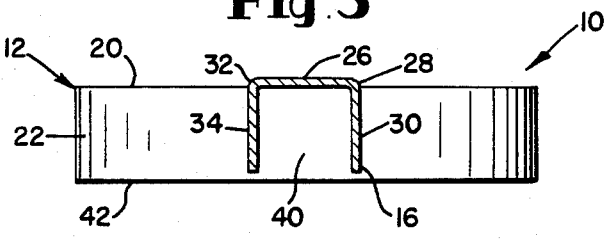
FIG. 3 is another cross-sectional view taken along line 3—3′ of FIG. 1.

Referring now to the drawings and in particular to FIGS. 1, 2 and 3 there is shown a getter assembly 10 comprising a holder 12 supporting an evaporable getter metal vapour releasing material 14. A support tab member 16 comprises a first quadrilateral element 26 forming part of support tab member 16. One edge 24 of quadrilateral element 26 is integrally formed with and attached to the upper edge 20 of the outer wall 22 of the getter holder 12. Another edge 28 adjacent to edge 24 supports a second quadrilateral element or sidewall member 30; whereas, yet another edge 32 adjacent to edge 24 supports a third quadrilateral element or sidewall member 34. Sidewall members 30 and 34 are substantially perpendicular to quadrilateral element 26. Edges 36 and 38 of sidewall members 30 and 34 are in abutting relationship with outer wall 22 of holder 12.

The three quadrilateral elements 26, 30 and 34 form the substantially 'U' shaped tab member 16. The open portion 40 of 'U' shaped tab member 16 faces downwardly towards the bottom wall 42 of the getter holder 12.

Figure 4:
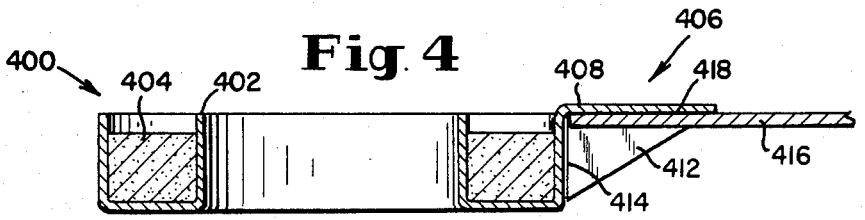
FIG. 4 is a cross-sectional view of another getter device incorporating an improved support tab member of the present invention.

Referring now to FIG. 4 there is shown a cross-section of an evaporable getter device 400 comprising a ring shaped holder 402 having a U-shaped channel cross-section supporting a getter metal vapour releasing material 404. A support tab member 406 comprises a quadrilateral element 408 integrally connected to ring shaped holder 402. A triangular reinforcing element 412 forms a sidewall member perpendicular to quadrilateral element 408 and abuts holder 402 along edge 414. A second side wall member, not shown, is attached to quadrilateral element 408 in a similar manner as shown in FIGS. 1 to 3 to form a 'U' shape.

An antenna spring 416 is attached to the lower surface 418 of quadrilateral element 408, by spot-welding.

Figure 5:
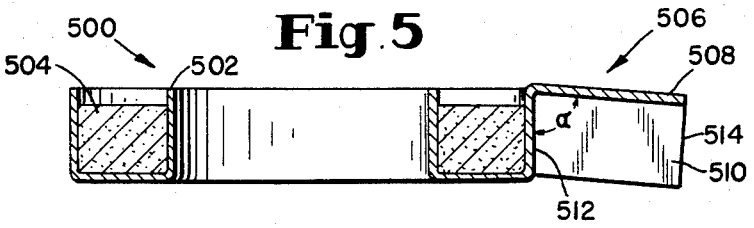
FIG. 5 is a cross-sectional view of a getter device incorporating a modified improved support tab of the present invention.

FIG. 5 shows an evaporable getter device 500 comprising a ring shaped holder 502 having a U-shaped channel cross-section supporting a getter metal vapour releasing material 504. A support tab member 506 comprises a quadrilateral element 508 and a quadrilateral sidewall member 510 perpendicular to element 508 and in abutting relationship with holder 502 along edge 512. Edge 512 forms an angle '$\alpha$', of, in this case, less than 90° with respect to supporting edge 514. A second side wall member, not shown, is attached to quadrilateral element 508 in a similar manner as shown in FIGS. 1 to 3 to form a 'U' shape.

It will be realized that angle '$\alpha$' could be greater than 90° if desired.

FIGS. 6 and 7 show a modified getter device 600 comprising a getter holder 602 having an outer wall 604 and a bottom wall 606 supporting an evaporable getter metal vapour releasing material 608. Material 608 has a plurality of its surfaces exposed and not in contact with getter holder 602. A substantially disc shaped element 610 is attached to bottom wall 606 of holder 602 along its outer edge 612. Element 610 serves to reflect getter metal vapours which issue from the lower surface 614 of material 608. A support tab member 616 comprises a quadrilateral element 618 integrally connected along an edge 620 to the outer edge 620 of disc shaped reflecting element 610. Side wall members 622 and 624 are attached in perpendicular relationship to element 618 and are in abutting relationship with outer wall 604 of getter holder 602, thus forming tab member 616 in a 'U' shape. The open portion 626 of the tab member faces upwardly away from the bottom wall 606 of getter holder 602.

In use the choice of a getter device having either an upwardly or downwardly facing 'U' shaped tab member will depend on the forces that are exerted on the getter device while being heated to evaporate getter metal vapours. The device chosen is that in which the forces are such as to encourage the maintainance of the abutting relationship between the sidewall members and the getter holder.

Although the invention has been described in considerable detail with reference to certain preferred embodiments thereof, it will be understood that variations and modifications can be effected within the spirit and scope of the invention as described above and as defined in the appended claims.

What is claimed is:

1. An improved getter assembly which has a tab when heated by induction resists bending and therefore leaves the getter assembly in its original position; said getter assembly being especially useful when mounted in a cathode ray tube in the antenna position; and getter assembly comprising:

A. a U-shaped holder is the form of an annular ring having an inner-wall an outer wall and a bottom wall joining the inner wall with the outer wall; and B. an evaporable getter metal releasing material comprising a mixture of a barium-aluminium alloy and nickel in the holder; and C. a supporting tab attached to the outer wall and integral therewith; said supporting tab comprising:

(1) a quadrilateral element one edge of which is attached to the outer wall of the getter assembly and is integral with the outer wall of the getter assembly; and (2) a first downwardly extending side wall member attached at its top to the quadrilateral element and integral therewith said side wall member being:

(a) perpendicular to the quadrilateral element; and (b) having an edge in abutting relationship and substantially perpendicular to the outer wall of the holder; and (3) a second downwardly extending side wall member attached at its top to the quadrilateral element and integral therewith said side wall member being:

(a) perpendicular to the quadrilateral element; and (b) having an edge in abutting relationship and substantially perpendicular to the outer wall of the holder; and wherein the first side wall member is substantially parallel to the second side wall member;

wherein when the quadrilateral element is heated and tends to bend, the edges of the first and second side wall members contact the outer wall of the getter assembly and inhibit bending of the quadrilateral element leaving the getter assembly in its original position.

2. An improved getter assembly which has a tab when heated by induction resists bending and therefore leaves the getter assembly in its original position; said getter assembly being especially useful when mounted in a cathode ray tube in the antenna position; said getter assembly comprising:

A. a holder is the form of an annular ring having an outer wall and a bottom wall attached to the outer wall; and B. an evaporable getter metal releasing material comprising a mixture of a barium-aluminium alloy and nickel in the holder; and C. a disc-shaped element attached to the bottom wall of the holder; and D. a supporting tab attached to the disc-shaped element and integral therewith; said supporting tab comprising;

(1) a quadrilateral element one edge of which is attached to the disc-shaped element and is integral therewith; and (2) a first upwardly extending side wall member attached at its bottom to the quadrilateral element and integral therewith said side wall member being:

(a) perpendicular to the quadrilateral element; and (b) having an edge in abutting relationship and substantially perpendicular to the outer wall of the holder; and (3) a second upwardly extending side wall member attached at its bottom to the quadrilateral element and integral therewith said side wall member being:

(a) perpendicular to the quadrilateral element; and (b) having an edge in abutting relationship and substantially perpendicular to the outer wall of the holder; and wherein the first side wall member is substantially parallel to the second side wall member;

wherein when the quadrilateral element is heated and tends to bend, the edges of the first and second side wall members contact the outer wall of the getter assembly and inhibit bending of the quadrilateral element leaving the getter assembly in its original position.

* * * * *